US010755543B1

(12) United States Patent
Usie

(10) Patent No.: US 10,755,543 B1
(45) Date of Patent: Aug. 25, 2020

(54) BRIDGE DEVICE SUPPORTING ALARM FORMAT

(71) Applicant: CHeKT LLC, Shreveport, LA (US)

(72) Inventor: Wesley Robert Usie, Shreveport, LA (US)

(73) Assignee: CHEKT LLC, Shreveport, LA (US)

( * ) Notice: Subject to any disclaimer, the term of this patent is extended or adjusted under 35 U.S.C. 154(b) by 0 days.

(21) Appl. No.: 16/505,491

(22) Filed: Jul. 8, 2019

(51) Int. Cl.
*G08B 13/196* (2006.01)

(52) U.S. Cl.
CPC ... *G08B 13/19676* (2013.01); *G08B 13/1966* (2013.01); *G08B 13/19645* (2013.01); *G08B 13/19689* (2013.01)

(58) Field of Classification Search
None
See application file for complete search history.

(56) References Cited

U.S. PATENT DOCUMENTS 4,458,266 A * 7/1984 Mahoney ..... G08B 13/19606 340/541
4,511,886 A * 4/1985 Rodriguez ..... G08B 13/19645 340/506
5,202,661 A * 4/1993 Everett, Jr. ..... G08B 13/00 340/522
5,237,408 A * 8/1993 Blum ..... H04N 7/181 348/154
5,828,848 A * 10/1998 MacCormack .. G08B 13/19604 709/247
5,862,201 A * 1/1999 Sands ..... G08B 29/16 379/27.06
5,862,342 A * 1/1999 Winter ..... G08B 13/19604 709/231
5,875,304 A * 2/1999 Winter ..... G08B 13/19604 709/231
5,875,305 A * 2/1999 Winter ..... G08B 13/19604 709/231
5,884,042 A * 3/1999 Winter ..... G08B 13/19604 709/231
5,909,548 A * 6/1999 Klein ..... G08B 13/19604 709/217
5,974,235 A * 10/1999 Nunally ..... G08B 13/19604 709/202
6,031,573 A * 2/2000 MacCormack .. G08B 13/19604 375/240.16
6,049,353 A * 4/2000 Gray ..... H04N 7/088 340/3.32
6,081,606 A * 6/2000 Hansen ..... G06K 9/00771 348/699

(Continued)

*Primary Examiner* — Jayanti K Patel
*Assistant Examiner* — Stefan Gadomski
(74) *Attorney, Agent, or Firm* — Heedong Chae; Lucem, PC

(57) ABSTRACT

Disclosed is a bridge device supporting an alarm format, which transmits an event which occurs based on an image of a camera that photographs a monitoring area of an alarm panel in an alarm format according to an alarm format of an alarm panel transmitting alarm information in a predetermined alarm format when sensing by a sensor in the monitoring area in the alarm format and supports to interlock with the alarm panel while providing an image of the monitoring area where an event corresponding to the alarm information of the alarm panel.

7 Claims, 4 Drawing Sheets

(56) References Cited

U.S. PATENT DOCUMENTS 6,292,098 B1 * 9/2001 Ebata ..... G08B 13/19656 340/506
6,445,409 B1 * 9/2002 Ito ..... G01S 3/783 348/155
6,642,954 B1 * 11/2003 Parker ..... H04N 7/181 348/143
6,747,554 B1 * 6/2004 Higashimura ... G08B 13/19645 340/506
7,113,085 B2 * 9/2006 Havekost ..... G05B 23/027 340/506
7,460,149 B1 * 12/2008 Donovan ..... G11B 27/105 348/143
9,374,239 B2 * 6/2016 Martin ..... H04L 12/2838
9,812,000 B2 * 11/2017 Sivakumar ..... G08B 25/004
10,129,774 B2 * 11/2018 Chou ..... H04W 24/04
10,140,839 B1 * 11/2018 Smith ..... G08B 25/001
2002/0067258 A1 * 6/2002 Lyons ..... G08B 13/19602 340/541
2003/0093430 A1 * 5/2003 Mottur ..... H04N 21/64322
2004/0113770 A1 * 6/2004 Falk ..... G08B 13/19673 340/531
2006/0255926 A1 * 11/2006 Okada ..... G08B 26/00 340/505
2007/0139192 A1 * 6/2007 Wimberly ..... G08B 13/19697 340/539.22
2007/0252693 A1 * 11/2007 Janson ..... G08B 13/1961 340/541
2008/0117922 A1 * 5/2008 Cockrell ..... H04L 65/1023 370/401
2008/0252448 A1 * 10/2008 Agarwalla ..... G08B 13/1968 340/540
2009/0312853 A1 * 12/2009 Kore ..... G05B 19/4185 700/90
2011/0130957 A1 * 6/2011 M ..... G08B 13/19645 701/533
2011/0153766 A1 * 6/2011 Ramchandani ..... H04L 41/0226 709/207
2012/0038456 A1 * 2/2012 Pikkarainen ..... G08B 13/181 340/5.61
2012/0122418 A1 * 5/2012 Hicks, III ..... G08B 25/08 455/404.1
2012/0307051 A1 * 12/2012 Welter ..... G08B 13/2482 348/143
2013/0120131 A1 * 5/2013 Hicks, III ..... G08B 25/004 340/501
2013/0120132 A1 * 5/2013 Hicks, III ..... H04W 4/90 340/501
2013/0120133 A1 * 5/2013 Hicks, III ..... H04W 4/90 340/501
2013/0120138 A1 * 5/2013 Hicks, III ..... G08B 25/08 340/538
2016/0025846 A1 * 1/2016 Mostov ..... G06K 9/00771 342/28
2016/0093176 A1 * 3/2016 Sharma ..... G08B 5/00 340/541
2016/0170577 A1 * 6/2016 Meganathan ..... G06F 3/0482 348/159
2017/0070775 A1 * 3/2017 Taxier ..... G11B 27/34
2017/0076582 A1 * 3/2017 Lewandowski ..... G08B 23/00
2019/0295392 A1 * 9/2019 Johan ..... G08B 13/19667

* cited by examiner

| SUBSCRIBER ID | Occurred | Condition | Description | Signal ID | Zone |
|---|---|---|---|---|---|
| 27948 | 3/24/2018 02:06:01 AM | RECOVERY | PARKING LOT MOTION SENSOR: RECOVERED | R136 | 029 |
| 27948 | 3/24/2018 02:05:20 AM | ALARM | PARKING LOT CAMERA: IMAGE VERIFYING – THROUGH SHARED LINK | E610 | 029 |
| 27948 | 3/24/2018 02:05:00 AM | ALARM | PARKING LOT CAMERA: GENERATING IMAGE SHARING LINK | E759 | 029 |
| 27948 | 3/24/2018 02:04:50 AM | ALARM | PARKING LOT CAMERA: USER RESPONDS TO DISPATCH OF POLICE FOR ALARM | E757 | U002 |
| 27948 | 3/24/2018 02:04:40 AM | ALARM | PARKING LOT CAMERA: USER VERIFIES ALARM | E754 | U002 |
| 27948 | 3/24/2018 02:04:30 AM | ALARM | PARKING LOT CAMERA: REQUESTING USER TO VERIFY ALARM | E753 | 029 |
| 27948 | 3/24/2018 02:04:20 AM | ALARM | ALL CAMERAS OF SITE: VERIFYING IMAGE | E609 | 900 |
| 27948 | 3/24/2018 02:04:13 AM | ALARM | PARKING LOT CAMERA: ALARM | E136 | 029 |
| 27948 | 3/24/2018 02:04:10 AM | ALARM | PARKING LOT MOTION SENSOR: ALARM | E136 | 029 |

FIG.3

BRIDGE DEVICE SUPPORTING ALARM FORMAT

BACKGROUND OF THE INVENTION

Field of the Invention

The present invention relates to a bridge device supporting an alarm format, and more particularly, to a bridge device supporting an alarm format, which transmits an event which occurs based on an image of a camera that photographs a monitoring area of an alarm panel in an alarm format according to an alarm format of an alarm panel transmitting alarm information in a predetermined alarm format when sensing by a sensor in the monitoring area in the alarm format and supports to interlock with the alarm panel while providing an image of the monitoring area where an event corresponding to the alarm information of the alarm panel.

Description of the Related Art

With continuous development of current Internet networks and various devices associated with security using the Internet networks, provided is a security system with high performance, which transmits, when an alarm is generated by sensing a human body through a sensor constructed in a monitoring area or an event is sensed by analyzing an image of a camera constructed in the monitoring area, the alarm or event to a monitoring center that is positioned remotely and manages security related devices and supports a response to the alarm or event to be rapidly made.

Further, the security system is provided through a telephone network even in the past in which the Internet network is not activated and such an existing security system is configured to include an alarm panel connected to a plurality of sensors configured in a plurality of different monitoring areas, respectively and the alarm panel is configured to communicate with the monitoring center through a telephone network in an initial stage, but operates to transmit alarm information to the monitoring center as a digital signal at the time of receiving a sensing signal depending on sensing from the sensor by supporting the Internet network in recent years.

Since the sensor connected to the alarm panel just senses the human body and transfers a signal therefor, the sensor senses an object other than a monitoring target object is sensed, a frequency in which a false alarm is generated in the alarm panel is high and in recent years, a police requires image based monitoring to the monitoring center due to such a frequent false alarm, but the alarm panel just transmits the alarm as the digital signal, and as a result, it is impossible for the alarm panel to process and analyze the image of the camera and the camera may not be connected to the alarm panel from the first.

In addition, since the camera is not a device for generating the alarm, but is a device for monitoring a site situation when the alarm occurs from the sensor, in order for an administrator of the monitoring center who is accustomed to the alarm format of the alarm panel to verify by distinguishing an event related image of the camera associated with the alarm by the sensor from another image, the administrator needs to be separately educated or a personnel should be recruited to determine an image based event of the camera.

Therefore, due to a connection problem of the camera to the alarm panel and burden of cost required for event judgment based on the image of the camera, a monitoring target space where the existing alarm panel based security system is constructed needs to be configured by connecting the camera to a separate system separately configured from the monitoring center, and as a result, it is difficult to match the alarm of the sensor and the image of the camera.

In addition, there is a possibility that a legal dispute will occurs with an insurance company of a user when the user is stolen or injured or there is a problem in life of the user and the monitoring center using the existing alarm panel may easily submit a log recorded according to the alarm format of the alarm panel to which only the sensor is connected as evidential data and finish the dispute, but when the camera is installed and an image based monitoring service is provided, the site situation may be verified by the image, and as a result, a lot of responsibilities are removed in the monitoring center operating the alarm panel and the monitoring center generating log information from information of a predetermined alarm format received from the alarm panel may not record a log related to the event which occurs by the camera, and as a result, there is a problem in that evidential data for proving a responsibility may not be generated, thereby being vulnerable to coping with the legal dispute at the time of operating the camera.

SUMMARY OF THE INVENTION

The present invention has been made in an effort to increase convenience and efficiency for a security by supporting an alarm generated by a sensor and an event generated based on an image of a camera to match each other in the same monitoring area while reducing a cost burden by supporting constructing a separate system for security monitoring based on the image of the camera or supporting a separate education for an administrator not to be performed by supporting the administrator of a monitoring center to easily verify an event related image corresponding to alarm information of an alarm panel by supporting event related event information the monitoring center according to a typical alarm format of an alarm panel transmitting the alarm information to a monitoring center which is remotely positioned at the time of generating a sensing signal of a sensor configured in a monitoring area at the time of sensing an event through analyzing an image received from the camera and sensing a human body.

The present invention has also been made in an effort to support evidential data for proving a responsibility to be easily provided even for an image based event of the camera by supporting event information transmitted in an alarm format of an alarm panel through sensing the event of the camera for the monitoring area or security processing related information such as whether a user verifies the event related image as a log like the alarm information of the alarm panel and supporting the event information or the security processing related information to be integrally managed with the log of the alarm information.

Moreover, the present invention has also been made in an effort to prevent intentional incapacitation for a bridge device and increase security by supporting an abnormality to be announced to a monitoring center when the abnormality occurs in the alarm panel or the bridge device by supporting whether the abnormality occurs in the bridge device managing the camera in connection with the camera photographing the monitoring area to be verified by the alarm panel or whether the abnormality occurs in the alarm panel to be verified by the bridge device.

An exemplary embodiment of the present invention provides a bridge device supporting an alarm format of an alarm panel, which generates alarm information including a zone number related to a monitoring area of a specific sensor predetermined to correspond to a channel connected with the specific sensor at the time of receiving a sensing signal from the specific sensor in connection with a plurality of sensors according to a predetermined alarm format and transmits the generated alarm information to a predetermined monitoring server, which may include: a camera registration unit configured to register different zone numbers for each of one or more cameras connected to the bridge device to be distinguished from the zone number of the alarm panel; a motion monitoring unit configured to sense a motion by analyzing an image received through the camera; a RAM disk configured to store temporary storage images before and after an event; and an event management unit configured to generate event information based on a sensing signal received from a camera sensor configured in the camera or a sensing result of the motion monitoring unit and generate the event information including the zone number registered through the camera registration unit in a format which is the same as the alarm format of the alarm panel with respect to the camera corresponding to the event information and then, transmit the generated event information to the monitoring server to allow the monitoring server to generate log information based on the event information according to the alarm format and transmit the temporary storage image received from the camera and temporarily stored in the RAM disk to an external cloud server which the monitoring server and a user terminal are capable of accessing.

As an example related to the present invention, the event management unit may generate link information including a connection address to the temporary storage image stored in the cloud server and transmit the generated link information to the monitoring server.

As an example related to the present invention, the event management unit may transmit to the cloud server image information including parameters included in the event information corresponding to the temporary storage image and the temporary storage image to enable the monitoring server to access the temporary storage image stored in the cloud server based on the parameters included in the event information.

As an example related to the present invention, the bridge device may further include a zone matching unit configured to store matching information generated by matching the zone numbers of the camera monitoring the same monitoring area and the sensor connected to the alarm panel and the event management unit may insert the zone number of the sensor that senses the monitoring area which is the same as the monitoring area of the specific camera or generate and insert a modification number acquired by combining the zone number of the sensor that senses the same monitoring area with the zone number of the specific camera and transmit the generated modification number.

As an example related to the present invention, the bridge device may further include an interface unit configured to include first and second digital communication terminals and be connected to the alarm panel; and a signal management unit configured to generate, when the event information depending on the sensing signal or the sensing result of the motion monitoring unit is not generated at the time of receiving an alarm signal corresponding to the alarm information from the alarm panel through the first digital communication terminal of the interface unit which operates normally closed, error occurrence related error information of the alarm panel in the format which is the same as the alarm format and transmit the generated error occurrence related error information to the monitoring server and generate status information for abnormality occurrence of the alarm panel in the format which is the same as the alarm format and transmit the generated status information to the monitoring server at the time of not receiving a predetermined operation signal from the alarm panel through the second digital communication terminal of the interface unit which operates normally open.

As an example related to the present invention, the signal management unit may control not to output a predetermined first status signal to the alarm panel through the first digital communication terminal but to output a predetermined second status signal through the second digital communication terminal when the bridge device is in a power on state and in the normal state and outputs the first status signal to the alarm panel through the first digital communication terminal when the event information is generated in link with the event management unit, and the interface unit may stop outputting the second status signal when the abnormality occurs in the bridge device or stop outputting the second status signal by controlling the signal management unit depending on the abnormality occurrence of the camera so as to enable the alarm panel to determine whether the abnormality occurs in the bridge device or the camera.

As an example related to the present invention, the bridge device may further include a camera setting unit configured to automatically change, when a new camera is connected in link with the camera registration unit, setting for the new camera according to predetermined camera setting information.

According to an exemplary embodiment of the present invention, a bridge device generates event information corresponding to a signal based alarm of a sensor generated by an alarm panel by sensing a motion through an image of a camera and generates the event information in the same format as alarm information related to the alarm and transmits the generated alarm information to a monitoring server to support an administrator of the monitoring server to verify an image based event of the camera associated with occurrence of the alarm of a sensor in a format of the alarm panel and supports the administrator to easily verify the event related image associated with the alarm of the sensor by distinguishing the event related image from another image and allows the event related image to be transferred to a user and supports the administrator or the user to clearly verify whether an error occurs in the alarm of the sensor through the transferred event related image to support to cope only with an alarm of a normal sensor, thereby supporting cost to be reduced because a separate system configuration for the camera or a separate education for the administrator is not required and management convenience of the administrator through the event information of the alarm format and management efficiency to be increased through accurate identification for an alarm error of the alarm panel.

Further, according to an exemplary embodiment of the present invention, as an image based event of a camera associated with the alarm of the sensor is provided in the same format as the alarm format of the alarm panel, evidential data is provided even for the image based event of the camera by supporting the event information depending on the event to be integrated with the alarm information of the alarm panel and remained as a log, thereby clearly locating a responsibility.

In addition, according to an exemplary embodiment of the present invention, since the bridge device may be connected to the alarm panel by the same interface as the sensor, when an abnormality occurs in at least one of the bridge device and the alarm panel, occurrence of the abnormality may be announced to a monitoring server through the other one to support a quick action to be taken and support an alarm with an error to be easily identified among alarms provided from the alarm panel to the monitoring center through an interface scheme using normally closed and normally open, thereby significantly increasing security efficiency by remarkably reducing an error frequency of the alarm.

BRIEF DESCRIPTION OF THE DRAWINGS

The above and other aspects, features and other advantages of the present invention will be more clearly understood from the following detailed description taken in conjunction with the accompanying drawings, in which:

FIG. 3 is an exemplary diagram of log information generated by a bridge device supporting an alarm format according to an exemplary embodiment of the present invention.

DETAILED DESCRIPTION OF THE PREFERRED EMBODIMENT

Hereinafter, detailed exemplary embodiments of the present invention will be described with reference to the drawings.

Figure 1:
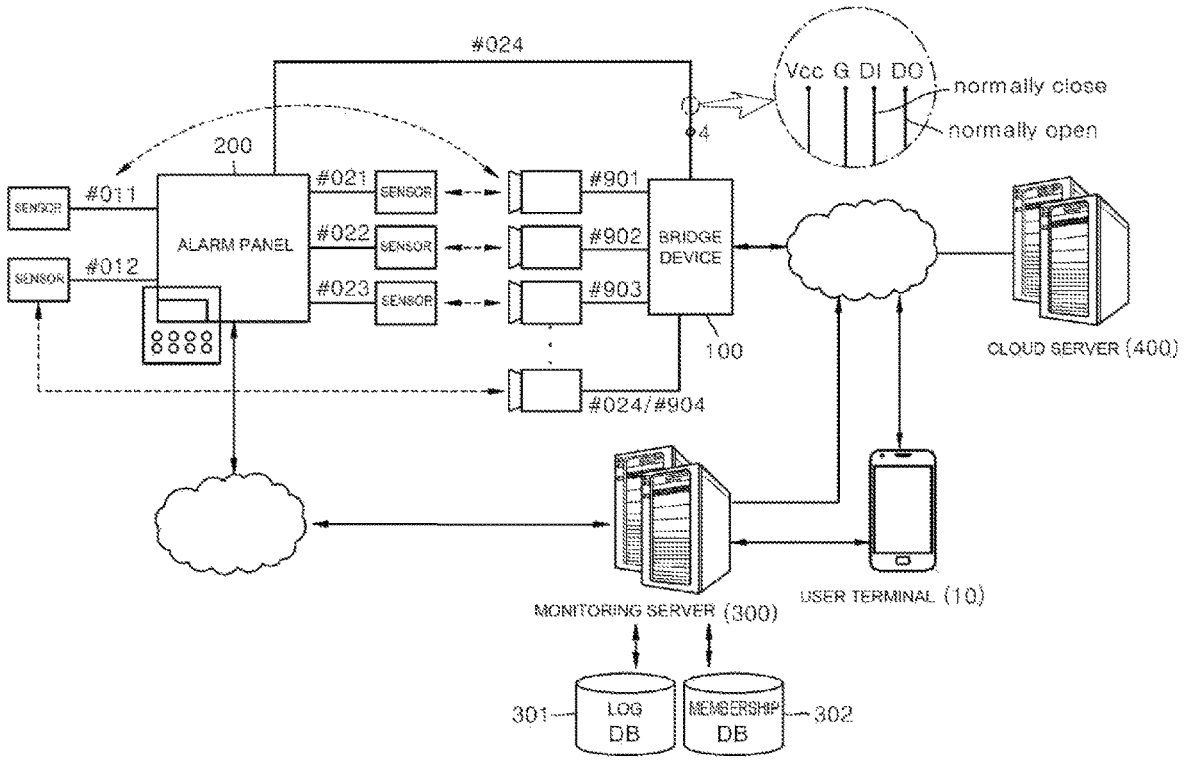
FIG. 1 is a configuration diagram of a security system including a bridge device supporting an alarm format according to an exemplary embodiment of the present invention.

FIG. 1 is a configuration diagram of a security system including a bridge device 100 supporting an alarm format according to an exemplary embodiment of the present invention.

As illustrated in the figure, the security system may be configured to include an alarm panel 200 to which a plurality of sensors positioned in a monitoring target space of a user are connected, a bridge device connected to at least one camera that captures the monitoring target space and positioned in the monitoring target space, and a monitoring server 300 communicating with the alarm panel 200 and the bridge device 100 through a communication network and remotely positioned remotely from the alarm panel 200 and the bridge device 100.

In this case, the sensor may be configured by a Passive Infrared Sensor (PIR) sensor module that senses a human body.

Further, the monitoring server 300 may be a server that configures a monitoring center.

Further, examples of the communication network may include wireless LAN (WLAN), Wi-Fi, digital living network alliance (DLNA), wireless broadband (Wibro), world interoperability for microwave access (Wimax), high speed downlink packet access (HSDPA), High Speed Uplink Packet Access (HSUPA), IEEE 802.16, long term evolution (LTE), Long Term Evolution-Advanced (LTE-A), wireless mobile broadband service (WMBS), 5G mobile communication service, Bluetooth, Radio Frequency Identification (RFID), Infrared Data Association (IrDA), Ultra Wideband (UWB), ZigBee, Near Field Communication (NFC), Ultra Sound Communication (USC), Visible Light Communication (VLC), Wi-Fi, Wi-Fi Direct, Long Range (LoRa), Public Switched Telephone Network (PSTN), Power Line Communication (PLC), USB communication, Ethernet, serial communication, and the like.

In this case, in the alarm panel 200, a plurality of different zone numbers corresponding to the plurality of sensors, respectively may be set and for example, a zone number may be preset by matching with a channel to which the sensor is connected.

That is, in the alarm panel 200, a zone number for a monitoring area sensed by the sensor for each of the plurality of sensors may be preset and the plurality of sensors may be disposed corresponding to different monitoring areas.

Further, the alarm panel 200 may include a zone number corresponding to a specific sensor at the time of receiving a sensing signal depending on sensing of the human body from the specific sensor among the plurality of sensors and generate alarm information related to an alarm of a predetermined alarm format to correspond to the sensing signal of the specific sensor and transmit the alarm information to the monitoring server 300 through the communication network.

In the existing security system, since the alarm panel 200 transmits the alarm information as a digital signal, the alarm panel 200 may not be connected to a camera, and an administrator of the monitoring server 300, who is familiar with the alarm format of the alarm panel 200 analyzes an image of the camera and identifies event information related to a generated event by matching with the alarm information and it is difficult to conform the image related to the alarm through the identified event information. Therefore, in order to resolve such a difficulty, a security system according to an exemplary embodiment of the present invention may be configured to include a bridge device 100 supporting the alarm format, which is positioned in the monitoring target space of the user and is capable of generating the event information depending on the alarm format in association with the camera.

The bridge device 100 may be connected to one or more cameras as illustrated in the figure and similarly to the alarm panel 200, a zone number corresponding to a channel to which the camera is connected for each camera is preset in the bridge device 100.

That is, in the bridge device 100, a zone number corresponding to a monitoring area photographed by a camera is set in advance for each of one or more cameras and when the one or more cameras are plural, a plurality of cameras are set to correspond to different zone numbers.

In this case, the zone number set to correspond to the camera in the bridge device 100 may be different from the zone number set in the alarm panel 200.

Accordingly, the bridge device 100 may monitor the images received from each of the plurality of cameras, analyze the images received from the specific camera, and generate event information according to the alarm format upon sensing a motion.

In this case, the bridge device 100 may transmit the event information including the zone number of specific number to the monitoring server 300.

In addition, the one or more cameras may be an Internet Protocol (IP) camera supporting an Open Network Video Interface Forum (ONVIF) standard and a camera sensor for sensing the human body may be configured in the camera.

Accordingly, the bridge device 100 may determine that an event occurs when a sensing signal is received from the camera sensor configured in the camera, generate the event-related event information according to the alarm format, and generate the event information including the zone number of the camera with the camera sensor transmitting the sensing signal included in the event information.

Further, the camera may generate the event through the image analysis in itself and the bridge device 100 may generate the event information depending on the alarm format at the time of receiving the event related signal from the camera.

In the aforementioned configuration, the alarm information may include a unique ID of the alarm panel 200, an alarm occurrence time, an alarm type, a zone number, a user identification code, and the like according to the alarm format.

Further, the event information may include a unique ID of the bridge device 100, an alarm occurrence time, an alarm type, a zone number, a user identification code, and the like according to the alarm format.

Meanwhile, when the alarm information is received from the alarm panel 200, the monitoring server 300 may verify that the alarm occurs in the alarm panel 200 based on the alarm information, and may extract a parameter for each predetermined attribute from the alarm information according to the alarm format, and generate log information including the parameter for each attribute and store the generated log information in a log DB 31 included in the monitoring server 300.

In this case, the monitoring server 300 may extract the zone number included in the alarm information and encapsulate the extracted zone number in the log information.

Further, when receiving the event information from the bridge device 100, the monitoring server 300 may extract the parameter for each of the predetermined attribute from the event information according to the alarm format from the event information, and generate log information for the parameter for each attribute and store the log information in the DB 301.

In this case, the monitoring server 300 may extract the zone number included in the event information and encapsulate the zone number in the log information generated to correspond to the event information.

Accordingly, the monitoring server 300 sequentially integrally stores log information generated based on the alarm information received from the alarm panel 200 and log information generated based on the event information received from the bridge device 100 in the log DB 301 in a time order depending on an alarm occurrence time and an event occurrence time to support whether the alarm information transmitted from the alarm panel 200 is normal to be verified based on the event information.

Meanwhile, the bridge device 100 may temporally store an event-related image among the images received through the camera to correspond to the event information in a ran disk configured in the bridge device 100 and transmit a temporary storage image temporally stored in the RAM disk to an external cloud server 400 which communicates with the bridge device 100 through the communication network.

In this case, the bridge device 100 may select a plurality of frames belonging to a predetermined time before and after the occurrence of the event according to the event information among the frames constituting the image corresponding to the event information and then, extract the frames from the image and store the generated event related image in the RAM disk 114 as the temporary storage image and transmit the stored event related image to the cloud server 400.

Accordingly, the bridge device 100 may store only an image of a small capacity of a short time related to the event and temporarily store the image in the RAM disk 114 for a predetermined period, thereby reducing the load on the bridge device 100 and guarantee a significantly long life-time corresponding to the life-time of the alarm panel 200 having a service life of several years through the reduction of the load and support only minimum management for the bridge device 100 to be performed by minimizing replacement of consumables, thereby increasing management convenience for the bridge device 100.

Further, the bridge device 100 may generate image information including some parameters of the event information and the temporary storage image and transmit the generated image information to the cloud server 400 so as to search and access the temporary storage image stored in the cloud server 400 based on the event information in the user terminal 10 of the user or the monitoring server 300 and store the image information including the temporary storage image in the cloud server 400.

Alternatively, the bridge device 100 may generate link information including a connection address (access address) of the temporary storage image stored in the cloud server 400 and encapsulate the generated link information in the event information or transmit the generated link information to the monitoring server 300 together with the event information.

In addition, the monitoring server 300 may access the cloud server 400 based on the event information, receive the temporary storage image from the cloud server 400, and display the temporary storage image.

Accordingly, the monitoring server 300 may support the administrator to identify the event information associated with the alarm information of the alarm panel 200 based on the zone number, and receive a temporary storage image related to the event information associated with the alarm information and display the temporary storage image and support the administrator to verify the temporary storage image associated with the alarm information and distinguish whether the alarm information is a false alarm or a normal alarm.

To this end, in the monitoring server 300, a matching table may be set in advance, in which the zone numbers set in the bridge device 100 for the same monitoring area match each other for each zone number set in the alarm panel 200 and when the monitoring server 300 receives the alarm information and the event information, the monitoring server 300 may display the image associated with the alarm information searched by the cloud server 400 and received from the cloud server 400 based on the event information while displaying the event information corresponding to the alarm information based on the matching table.

In this case, the matching table may be included in the member information of a membership DB 302 included in the monitoring server 300 and storing membership information of the user.

Further, upon receiving the event information, the monitoring server 300 may generate event notification information for notification of an event including the temporary storage image received from the cloud server 400 in response to the event information at the time of receiving the event information and then, transmit the generated event notification information to the user terminal 10 of the user according to membership information identified based on a user identification code included in the event information.

To this end, the monitoring server 300 may include the membership DB 302 storing the membership information of the user and may identify the membership information of the user in the membership DB 302 based on the user identification code extracted from the event information and transmit the event notification information to the user terminal 10 of the user based on contact information of the user terminal 10 included in the membership information of the user.

Alternatively, the monitoring server 300 may generate the event notification information including the link information received by matching the event notification information with the event information from the bridge device 100 to the event notification information and transmit the event notification information to the user terminal 10 and the user terminal 10 may access the temporary storage image stored in the cloud server 400 based on the link information and receive and display the temporary storage image.

In this case, the monitoring server 300 may generate log information corresponding to the event notification information when transmitting the event notification information to the user terminal 10 and may store the generated log information in the log DB 301.

Further, the monitoring server 300 may receive response information from the user terminal 10 in response to the event notification information and when it is determined that the user determines that the event occurs based on the response information (when it is determined that the alarm of the alarm panel 200 is the normal alarm), the monitoring server 300 may transmit the event notification information to a server of a public institution of such as a predetermined police and notify event occurrence.

Further, the monitoring server 300 may generate the log information based on the response information and store the generated log information in the log DB 301 and generate the log information to correspond to the event notification information transmitted to the server of the public institution and store the generated log information in the log DB 301.

According to the above-described configuration, the bridge device 100 according to the present invention senses the motion through the image of the camera and generates event information corresponding to a signal-based alarm of the sensor generated by the alarm panel 200 and generates the event information in the same format as alarm information related to the alarm and transmits the generated event information to the monitoring server 300 to support the administrator of the monitoring server 300 to verify the image based event of the camera associated with the alarm occurrence in the format of the alarm panel 200 and support the administrator to distinguish and easily verify the event related image associated with the alarm of the sensor from another image and transfer the event related image to the user and support the administrator or the user to clearly verify whether the error occurs in the alarm of the sensor through the image via the transferred event related image and to support to cope only with the alarm of the normal sensor, and as a result, a separate system configuration for the camera or a separate education for the administrator is not required to reduce cost and management convenience of the administrator may be enhanced through the event information of the alarm format and management efficiency may be enhanced through accurate identification for the error alarm of the alarm panel 200.

In addition, according to the present invention, since the event related to the image of the camera is provided in the same format as the alarm format of the alarm panel 200, evidential data is provided even with respect to the image based event of the camera by supporting the event information according to the event to be integrated with the alarm information of the alarm panel 200 and left as a log to support a responsibility to be clearly located.

Figure 4:
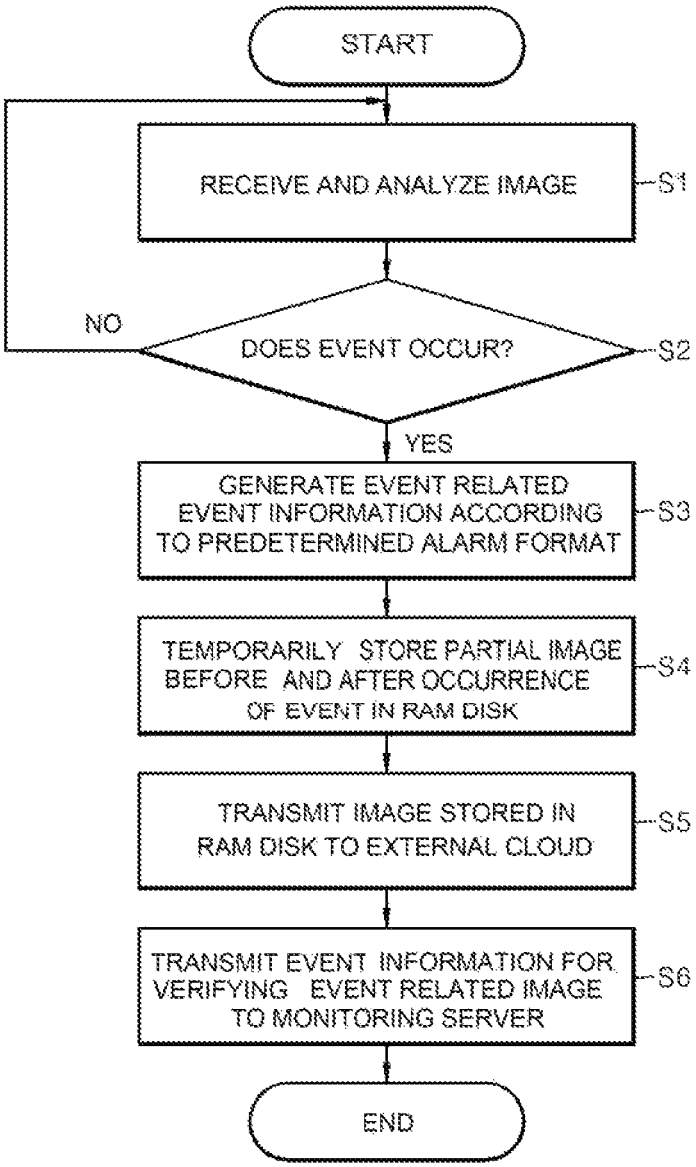
FIG. 4 is a flowchart of an operation of a bridge device supporting an alarm format according to an exemplary embodiment of the present invention.

Based on the aforementioned configuration, a detailed operation configuration of the bridge device 100 supporting the alarm format according to the exemplary embodiment of the present invention will be described through configurations of FIGS. 2 to 4.

Figure 2:
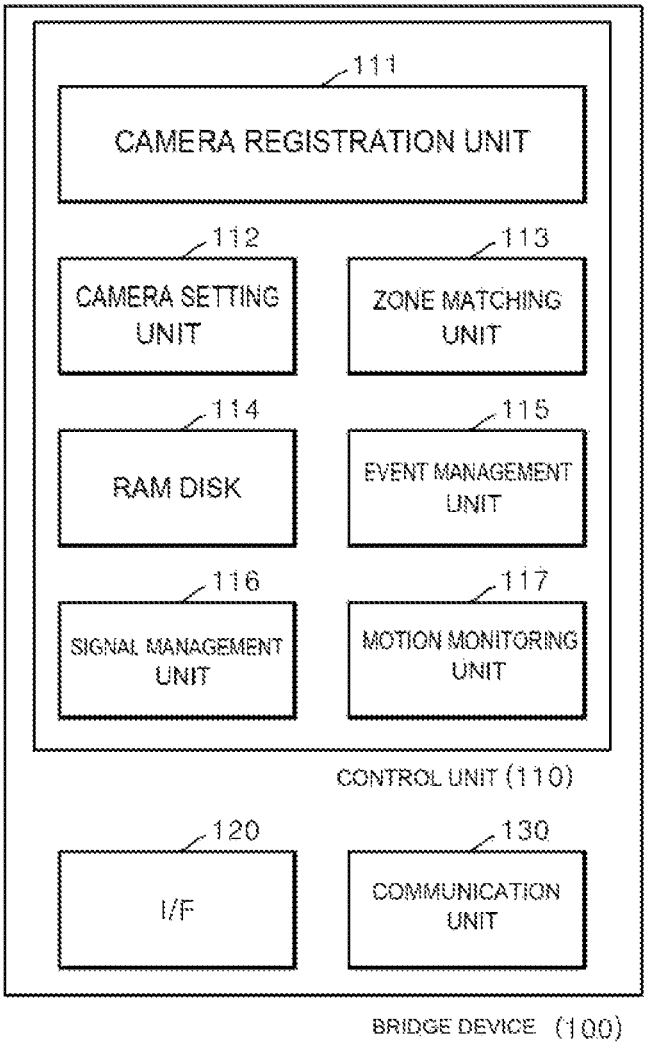
FIG. 2 is a configuration diagram of a bridge device supporting an alarm format according to an exemplary embodiment of the present invention.

First, FIG. 2 is a detailed configuration diagram of a bridge device 100 supporting an alarm format according to an exemplary embodiment of the present invention and as illustrated in the figure, the bridge device 100 may be configured to include a control unit 110 including a camera registration unit 111, a camera setting unit 112, a zone matching unit 113, a RAM disk 114, an event management unit 115, a signal management unit 116, and a motion monitoring unit 117, a communication unit 130 for communication with the monitoring server 300 and the cloud server 400, and an interface unit 120 connected to one or more cameras.

In this case, the control unit 110 executes an overall control function of the bridge device 100 using previously stored programs and data. The control unit 110 may include a RAM, a ROM, a CPU, a GPU, and a bus and the RAM, the ROM, the CPU, and the GPU may be connected to each other via the bus. The CPU may perform booting using a pre-stored O/S and perform various operations using various pre-stored programs, contents, data, and the like.

Further, the bridge device 100 may be configured to further include a separate storage unit for storing the programs and data and the control unit 110 may perform the overall control function of the bridge device 100 by using the programs and data stored in the storage unit. Further, the storage unit may be configured to be included in the control unit 110.

An operation exemplary embodiments will be described for each component constituting the control unit 110.

First, the camera registration unit 111 may recognize the camera connected to the interface unit 120 of the bridge device 100 and register as the zone number of the camera a predetermined zone number corresponding to a channel to which the camera is connected among a plurality of channels configured in the interface unit 120.

In this case, when the camera is connected to the interface unit 120, the camera registration unit 111 may generate registration information including the zone number of the channel connected to the camera and media access control (MAC) information (MAC address) of the camera and transmit the generated registration information to the event management unit 115 and the event management unit 115 may store the registration information.

In addition, when the existing camera connected to a specific channel is replaced with a new camera different from the existing camera, the camera registration unit 111 may also set a zone number which is the same as the zone number set for the existing camera even with respect to the new camera connected to the specific channel.

As a result, when the camera is connected for each of plurality of channels connected to the interface unit 120, the event management unit 115 may set different zone numbers among the cameras in link with the camera registration unit 111 and then, generate and store a plurality of different registration information including different zone numbers.

In this case, the zone number set for each camera in the bridge device 100 may be set to be distinguished from the zone number set in the alarm panel 200 for each sensor and as an example, the zone number of the camera may be set in 900 series (for example, #901, #902, etc.) and the zone number of the sensor may be set in 20 series (for example, #021, #022, etc.). Therefore, the monitoring server 300 may distinguish the alarm information transmitted by the alarm panel 200 and the event information transmitted by the bridge device 100 from each other based on a range to which the zone number belongs.

In addition, the camera setting unit 112 may change and optimize setting of the new camera according to predetermined camera setting information in order to generate an image according to a predetermined standard by the new camera at the time of connecting the new camera to the specific channel of the interface unit 120 in link with the camera registration unit 111.

As an example, the camera setting unit 112 may change and optimize various settings of the new camera including a resolution, Real Time Streaming Protocol (RTSP) stream url, frame per second (FPS), and the like according to the camera setting information.

Meanwhile, the motion monitoring unit 117 may sense the motion of the object in the image by analyzing the image according to a predetermined image analysis algorithm after receiving the image of the camera and generate result information regarding a sensing result at the time of sensing the motion and provide the generated result information to the event management unit 115.

Further, the event management unit 115 may receive the sensing signal from the camera sensor configured in the camera or receive the result information regarding the sensing result from the motion monitoring unit 117 (S1).

In addition, the event management unit 115 may identify registration information corresponding to a specific camera of which motion is sensed based on the sensing signal or the result information and extract the zone number corresponding to the specific camera from the registration information.

Further, the event management unit 115 may generate event information depending on the event occurrence based on the sensing signal or result information (S2 and S3).

In this case, the event management unit 115 may generate event information registered through the camera registration unit 111 with respect to the specific camera corresponding to the event information and including the zone number extracted from the pre-stored registration information and generate the event information in a format which is the same as the alarm format used at the time of generating the alarm information by the alarm panel.

In addition, the event management unit 115 may extract from the image received from the specific camera a partial image which belongs to a predetermined time before and after an occurrence time of a motion sensing related event depending on the result information received from the motion monitoring unit 117 or the sensing signal of the camera sensor and temporarily store the partial image in the RAM disk 114 as the temporary storage image (S4).

Further, the event management unit 115 may transmit the temporary storage image stored in the RAM disk 114 to the predetermined external cloud server 400 through the communication unit 130 and allow the temporary storage image to be stored in the cloud server 400 (S5).

In addition, the event management unit 115 may transmit the event information to the monitoring server 300 through the communication unit 130 (S6).

In this case, the event management unit 115 may generate image information including the temporary storage image and some parameters of the event information and transmit the generated image information to the cloud server 400 so as to search the temporary storage image through the cloud server 400 as described above and allow the image information to be stored in the cloud server 400.

In this case, the some parameters may include the event occurrence time, the zone number, the user identification code, the unique ID of the bridge device 100, and the like.

In the aforementioned configuration, the zone matching unit 113 of the bridge device 100 may generate and store matching information acquired by matching the zone number set through the camera registration unit 111 and the zone number of the specific sensor with respect to the camera that photographs a monitoring area which is the same as the monitoring area which is the sensing target of the specific sensor connected to the alarm panel 200.

In this case, the zone matching unit 113 may match the zone number for each of a plurality of cameras and the zone number of the specific sensor when there are a plurality of cameras that photograph the monitoring area which is the same as the monitoring area of the specific sensor and on the contrary, match the zone number of a specific camera that photographs monitoring areas which are the same as the monitoring areas of a plurality of sensors sensing the same monitoring area and the zone number for each of the plurality of sensors and set the matched zone numbers in the matching information.

As a result, the event management unit 115 may insert the zone number of the sensor that senses the monitoring area which is the same as the monitoring area of the specific camera or generate and insert a modification number acquired by combining the zone number of the sensor that senses the same monitoring area with the zone number of the specific camera and transmit the generated modification number to the monitoring server 300.

According to the aforementioned configuration, the monitoring server 300 may receive event information from the bridge device 100 and identify alarm information corresponding to the event information based on the zone number included in the event information and may verify whether the alarm information received by the alarm panel 200 is a false alarm based on the event information.

As an example, the monitoring server 300 may distinguish the alarm information received from the alarm panel 200 and the event information received from the bridge device 100 from each other based on the unique ID of the alarm panel 200 included in the alarm information and the unique ID of the bridge device 100 included in the event information and identify alarm information including a zone number which is identical to the zone number included in the event information.

As a result, the monitoring server 300 may determine that the alarm information is the normal alarm when the alarm information and the event information are received to correspond to the sensor and the camera which monitor the same monitoring area, respectively.

In this case, the monitoring server 300 may store a matching pattern acquired by matching a first zone number of the specific sensor included in the alarm information received just before or just after the event information received from the bridge device 100 and a second zone number corresponding to the specific camera included in the event information and generate matching information acquired by matching the first zone number and the second zone number when the matching pattern is repeated a predetermined number of times or more by continuously receiving the event information and the alarm information and then, transmit the generated matching information to the bridge device 100 and allow the matching information to be set in the control unit 110.

That is, the monitoring server 300 may generate matching the information that matches the zone number of the specific camera that photographs the monitoring zone which is the same as the monitoring zone of the specific sensor with the zone number of the specific sensor and then, transmit the matching information to the bridge device 100 and allow the bridge device 100 to store the matching information generated by the monitoring server 300.

Meanwhile, the monitoring server 300 may access the cloud server 400 based on the event information and receive the temporary storage image corresponding to the event information from the cloud server 400 and output the temporary storage image through a display device connected to the monitoring server 300 and the administrator of the monitoring server 300 may operate to verify the event related image corresponding to the alarm information of the alarm panel 200 through the output temporary storage image.

Further, the monitoring server 300 may identify the membership information of the user in the membership DB 302 based on the user identification code included in the event information and then, transmit event notification information related to event occurrence generated based on the event information to the user terminal 10 identified based on the membership information.

Therefore, the user terminal 10 that receives the event notification information may receive and display the temporary storage image by accessing the cloud server 400 based on the event notification information and the user terminal 10 may generate response information for requesting the dispatch of the police or disregarding of the corresponding event to the monitoring server 300 according to an input of the user that verifies the event related image depending on sensing of the sensor and the camera corresponding to the event notification information and transmit the generated response information to the monitoring server 300.

Further, the monitoring server 300 may request the dispatch of the police by transmitting the event notification information to the server of the public institution or request the user to disregard the event corresponding to the event notification information and generate log information regarding a log related to an operation of disregarding the event information and store the generated log information in the log DB 301.

In this case, when the response information is not received in response to the event notification information, the monitoring server 300 may perform an operation according to predetermined operation setting information according to a contract with the user and generate log information related to the corresponding operation at the time of performing the operation depending on the operation setting information and store the generated log information in the log DB 301.

Further, the monitoring server 300 may extract a parameter for each attribute predetermined according to the alarm format in the event information and generate the log information and integrate the corresponding log information with the log information generated based on the alarm information of the alarm panel 200 and store and record the integrated log information in the log DB 301.

FIG. 3 illustrates an example of log information generated in response to a specific alarm and a specific event associated therewith in the monitoring server 300 according to the aforementioned configuration and as illustrated in the figure, the monitoring server 300 receives the alarm information from the alarm panel 200, receives event information from the camera corresponding to the monitoring area which is the same as the monitoring area of the sensor corresponding to the alarm information from the bridge device 100 after receiving the alarm information, and generates and stores the log information for each of the alarm information and the event information.

In this case, the bridge device 100 replaces the zone number included in the event information generated based on analysis of the image received from the specific camera with the zone number of the sensor that senses the same monitoring area as the specific camera and transmits the corresponding zone number.

Further, the monitoring server 300 generates and stores log information regarding verification of the temporary storage image corresponding to the event information by accessing the cloud server 400 and transmits the event notification information to the user terminal 10 corresponding to the event information and when requesting the verification of the temporary storage image, the monitoring server 300 generates and stores the log information based on the event notification information.

Further, the monitoring server 300 may generate and store the log information based on the response information at the time of receiving the response information of requesting the dispatch of the police by determining that the event occurs from the user terminal 10, transmit the event notification information to a police related public institution server, and generate and store log information related to an operation of transmitting the event notification information to the police.

Thereafter, the monitoring server 300 may recover the sensor corresponding to the event information or the event notification information, and generate and store the resulting log information.

As described above, the monitoring server 300 may generate the log information associated with the occurred event by analyzing the image of the camera connected to the bridge device 100 in addition to the sensor related alarm information and integrate the generated log information with the log information generated based on the alarm information of the sensor and store the integrated information and thus generate evidential data associated with the verification of the image of the camera.

Meanwhile, the bridge device 100 may notify to the monitoring server 300 the occurrence of the abnormality through the alarm panel when the abnormality occurs in the camera or the bridge device 100 or on the contrary, the bridge device 100 may verify whether the abnormality occurs in the alarm panel 200 and notify whether the abnormality occurs in the alarm panel 200 to the monitoring server 300, which will be described in detail with reference to FIGS. 1 and 2.

As illustrated in the figure, the interface unit 120 of the bridge device 100 may be connected and communicate with the alarm panel 200 by an interface which is the same as a communication interface for communication between the alarm panel 200 and the sensor.

As an example, in the interface unit 120, at least one of a plurality of channels may be configured to include a power supply terminal (or power supply line) Vcc, a ground terminal (or ground line) G, a first digital communication terminal (or first digital communication line) DI, and a second digital communication terminal (or second digital communication line) DO and the interface unit 120 may be connected to the alarm panel 200 by using a four-wire cable used for connection between the sensor and the alarm panel 200.

That is, the bridge device 100 may be connected to the alarm panel 200 like the sensor.

Further, the first digital communication terminal operates normally closed exclusively for an instruction sensing alarm for an alarm for a person (or object) sensed (or verified) through the signal of the sensor connected to the alarm panel 200 or the camera sensor configured in the camera or the sensing result through the image analysis for the image of the camera.

Further, the second digital communication terminal operates normally open exclusively for a trouble alarm of the alarm panel 200 or the bridge device 100.

According to the aforementioned configuration, the signal management unit 116 configured in the control unit 110 may verify whether the event information depending on the sensing signal of the camera sensor or the sensing result of the motion monitoring unit 117 is generated in link with the event management unit 115 at the time of receiving the alarm signal corresponding to the alarm information from the alarm panel 200 through the first digital communication terminal of the interface unit 120 which operates normally closed in which the signal is not received when the alarm information is not generated by the alarm panel 200.

In this case, the signal management unit 116 may determine that the alarm panel 200 generates the alarm while no motion is not sensed through the image analysis of the sensor configured in the camera or the camera when the event information is not generated according to whether the event information is generated and generate error information related to error occurrence of the alarm panel 200 in the format which is the same as the alarm format and transmit the generated error information to the monitoring server 300.

As a result, when the event information related to the alarm information generated by the alarm panel 200 and transmitted to the monitoring server 300 is not generated, the bridge device 100 may notify that the corresponding alarm information is erroneous to the monitoring server 300 through the error information and support the monitoring server 300 to disregard the alarm information corresponding to the error information based on the corresponding error information.

Meanwhile, the signal management unit 116 may generate status information for the abnormality occurrence of the alarm panel 200 in the format which is the same as the alarm format and transmit the generated status information to the monitoring server 300 at the time of not receiving the predetermined operation signal from the alarm panel 200 through the second digital communication terminal of the interface unit 120 which operates normally open in which the predetermined operation signal is received from the alarm panel 200 in a normal state in a state in which power is applied to the alarm panel 200 (ON state).

Therefore, the monitoring server 300 may verify that the abnormality occurs in the alarm panel 200 based on the status information received from the bridge device 100 and operate so that an action therefor is taken.

In this case, the monitoring server 300 may generate the log information corresponding to each of the error information and the status information generated according to the alarm format and store the generated log information in the log DB 301 and leave the evidential data.

As described above, the bridge device 100 according to the exemplary embodiment of the present invention may verify whether the alarm is erroneous or verify whether the alarm panel 200 is erroneous when the alarm is generated by the sensor in the alarm panel 200 and notify whether the alarm is erroneous or the alarm panel 200 is erroneous to the monitoring server 300 and support the monitoring server 300 to efficiently manage the information transmitted by the alarm panel 200 and the alarm panel 200 through the notification, thereby increasing security efficiency and security convenience.

Further, the signal management unit 116 may operate to notify the occurrence of the abnormality to the alarm panel 200 when the abnormality occurs in the bridge device 100 or the camera and announce the occurrence of the abnormality of the bridge device 100 in the alarm panel 200 to the monitoring server 300.

To this end, when the bridge device 100 is in a power ON state (or after booting completion/operation state/standby state) and in a normal state in which the event information is not generated, the signal management unit 116 does not transmit a predetermined first status signal to the alarm panel 200 in a closed state by controlling the first digital communication terminal and outputs (or transmits/provides) the first status signal to the alarm panel 200 through the first digital communication terminal at the time of generating the event information in link with the event management unit 115.

Accordingly, the alarm panel 200 may regard the first status signal received from the bridge device 100 as the signal of the sensor connected to the alarm panel 200 and receive the first status signal and generate the alarm information in the same scheme as the alarm information of the sensor to correspond to the first status signal and transmit the generated alarm information to the monitoring server 300.

In this case, in the alarm panel 200, a zone number (e.g., #24) may be set similarly to another sensor connected to the alarm panel 200 to correspond to the bridge device 100 and when the first status signal is received from the bridge device 100, the alarm information including the zone number of the bridge device 100 may be transmitted to the monitoring server 300.

Therefore, when the alarm information is not generated even with respect any sensor among the plurality of sensors connected to the alarm panel 200 while the monitoring server 300 receives the alarm information including the zone number corresponding to the bridge device 100, the monitoring server 300 may determine that the abnormality occurs in the sensor or the alarm panel 200 and generate the resulting abnormality occurrence information and output the generated abnormality occurrence information through the display device.

Further, the signal management unit 116 may control the interface unit 120 to output (provide) a predetermined second status signal to the alarm panel 200 through the second digital output terminal when the bridge device 100 is in the power on state and the normal state.

As a result, when an abnormality such as a power failure or occurrence of the error occurs in the bridge device 100, the interface unit 120 may stop outputting the second status signal output through the second digital output terminal and when the second status signal is not received from the bridge device 100, the alarm panel 200 may determine that the abnormality occurs in the bridge device 100, and generate the resulting failure signal and transmit the generated failure signal to the monitoring server 300.

Further, the signal management unit 116 may determine whether the abnormality occurs in the camera connected through the interface unit 120 and as an example, may verify a case where the power of the camera is interrupted, the signal management unit 116 through the interface unit 120.

Further, when verifying that the abnormality occurs in the camera, the signal management unit 116 may stop outputting the second status signal output through the second digital output terminal by controlling the interface unit 120 and when the second status signal is not received from the bridge device 100, the alarm panel 200 may determine that the abnormality occurs in the bridge device 100 or the camera, and generate the resulting failure signal and transmit the generated failure signal to the monitoring server 300.

Therefore, the monitoring server 300 may verify whether the abnormality occurs in the bridge device 100 or the camera based on the failure signal and operate so that an action therefor is taken.

As described above, according to the present invention, the bridge device may be connected to the alarm panel 200 by the same interface as the sensor and when the abnormality occurs in at least one of the bridge device 100 and the alarm panel 200, the occurrence of the abnormality may be announced to the monitoring server 300 through the other one to support a quick action to be taken and support an alarm with an error to be easily identified among alarms provided from the alarm panel to the monitoring center through an interface scheme using normally closed and normally open, thereby significantly increasing security efficiency by remarkably reducing an error frequency of the alarm.

Further, according to the present invention, it is possible to prevent intentional incapacitation for the bridge device 100 or the camera and enhance the security by verifying the occurrence of the abnormality between the bridge device 100 and the alarm panel 200.

Various apparatuses and components described in the present specification may be embodied by a hardware circuit (for example, a CMOS based logic circuit), firmware, software, or combinations thereof. For example, the apparatuses and components may be embodied by using a transistor, a logic gate, and an electronic circuit in the forms of various electric structures.

The aforementioned contents can be corrected and modified by those skilled in the art without departing from the essential characteristics of the present invention. Therefore, the exemplary embodiments of the present invention are provided for illustrative purposes only but not intended to limit the technical concept of the present invention. The scope of the technical concept of the present invention is not limited thereto. The protective scope of the present invention should be construed based on the following claims, and all the technical concepts in the equivalent scope thereof should be construed as falling within the scope of the present invention.

What is claimed is:

1. A bridge device supporting an alarm format of an alarm panel, which generates alarm information including a zone number related to a monitoring area of a specific sensor predetermined to correspond to a channel connected with the specific sensor at the time of receiving a sensing signal from the specific sensor in connection with a plurality of sensors according to a predetermined alarm format and transmits the generated alarm information to a predetermined monitoring server, comprising:

a camera registration unit configured to register different zone numbers for each of one or more cameras connected to the bridge device to be distinguished from the zone number of the alarm panel;

a motion monitoring unit configured to sense a motion by analyzing an image received through the camera;

a RAM disk configured to store temporary storage images before and after an event; and an event management unit configured to generate event information based on a sensing signal received from a camera sensor configured in the camera or a sensing result of the motion monitoring unit and generate the event information including the zone number registered through the camera registration unit in a format which is the same as the alarm format of the alarm panel with respect to the camera corresponding to the event information and then, transmit the generated event information to the monitoring server to allow the monitoring server to generate log information based on the event information according to the alarm format and transmit the temporary storage image received from the camera and temporarily stored in the RAM disk to an external cloud server which the monitoring server and a user terminal are capable of accessing.

2. The bridge device supporting an alarm format of claim 1, wherein the event management unit generates link information including a connection address to the temporary storage image stored in the cloud server and transmits the generated link information to the monitoring server.

3. The bridge device supporting an alarm format of claim 1, wherein the event management unit transmits to the cloud server image information including parameters included in the event information corresponding to the temporary storage image and the temporary storage image to enable the monitoring server to access the temporary storage image stored in the cloud server based on the parameters included in the event information.

4. The bridge device supporting an alarm format of claim 1, further comprising:

a zone matching unit configured to store matching information generated by matching the zone numbers of the camera monitoring the same monitoring area and the sensor connected to the alarm panel, wherein the event management unit inserts the zone number of the sensor that senses the monitoring area which is the same as the monitoring area of the specific camera or generates and inserts a modification number acquired by combining the zone number of the sensor that senses the same monitoring area with the zone number of the specific camera and transmits the generated modification number.

5. The bridge device supporting an alarm format of claim 1, further comprising:

an interface unit configured to include first and second digital communication terminals and be connected to the alarm panel; and a signal management unit configured to generate, when the event information depending on the sensing signal or the sensing result of the motion monitoring unit is not generated at the time of receiving an alarm signal corresponding to the alarm information from the alarm panel through the first digital communication terminal of the interface unit which operates normally closed, error occurrence related error information of the alarm panel in the format which is the same as the alarm format and transmit the generated error occurrence related error information to the monitoring server and generate status information for abnormality occurrence of the alarm panel in the format which is the same as the alarm format and transmit the generated status information to the monitoring server at the time of not receiving a predetermined operation signal from the alarm panel through the second digital communication terminal of the interface unit which operates normally open.

6. The bridge device supporting an alarm format of claim 5, wherein the signal management unit controls not to output a predetermined first status signal to the alarm panel through the first digital communication terminal but to output a predetermined second status signal through the second digital communication terminal when the bridge device is in a power on state and in the normal state and outputs the first status signal to the alarm panel through the first digital communication terminal when the event information is generated in link with the event management unit, and the interface unit stops outputting the second status signal when the abnormality occurs in the bridge device or stops outputting the second status signal by controlling the signal management unit depending on the abnormality occurrence of the camera so as to enable the alarm panel to determine whether the abnormality occurs in the bridge device or the camera.

7. The bridge device supporting an alarm format of claim 1, further comprising:

a camera setting unit configured to automatically change, when a new camera is connected in link with the camera registration unit, setting for the new camera according to predetermined camera setting information.

* * * * *